US007445122B2

(12) United States Patent
Currey

(10) Patent No.: US 7,445,122 B2
(45) Date of Patent: Nov. 4, 2008

(54) MECHANICAL BUCKET

(76) Inventor: Albert Ben Currey, 46631 N. 11th Ave., Phoenix, AZ (US) 85087

( * ) Notice: Subject to any disclaimer, the term of this patent is extended or adjusted under 35 U.S.C. 154(b) by 0 days.

(21) Appl. No.: 11/562,864

(22) Filed: Nov. 22, 2006

(65) Prior Publication Data

US 2008/0116119 A1 May 22, 2008

(51) Int. Cl.
*B07B 13/00* (2006.01)
*B07C 5/12* (2006.01)
*G21C 3/00* (2006.01)

(52) U.S. Cl. ..... 209/674; 209/671; 209/672; 209/673; 37/142.5; 37/319; 37/444

(58) Field of Classification Search ..... 209/662, 209/671, 672, 673, 674
See application file for complete search history.

(56) References Cited

U.S. PATENT DOCUMENTS

| | | | | |
|---|---|---|---|---|
| 1,677,838 | A | 7/1928 | Molin | |
| 1,679,593 | A | 8/1928 | Williamson et al. | |
| 1,899,737 | A | 2/1933 | Ulrich | |
| 2,830,703 | A | 4/1958 | Laase | |
| 4,146,483 | A * | 3/1979 | Lee | 210/384 |
| 4,452,694 | A | 6/1984 | Christensen et al. | |
| 4,658,965 | A | 4/1987 | Smith | |
| 4,972,960 | A | 11/1990 | Bielagus | |
| 5,160,034 | A * | 11/1992 | Potter | 209/38 |
| 5,423,430 | A * | 6/1995 | Zaffiro et al. | 209/315 |
| 5,493,796 | A * | 2/1996 | Ballew et al. | 37/142.5 |
| 5,590,792 | A | 1/1997 | Kobayashi | |
| 5,887,810 | A * | 3/1999 | Maruyama | 241/189.1 |
| 6,059,119 | A * | 5/2000 | Davis | 209/233 |
| 6,220,445 | B1 * | 4/2001 | Williams | 209/272 |
| 6,237,778 | B1 | 5/2001 | Weston | |
| 6,250,477 | B1 | 6/2001 | Swanink | |
| 6,266,901 | B1 * | 7/2001 | Kanda et al. | 37/403 |
| 6,371,305 | B1 | 4/2002 | Austin et al. | |
| 6,834,447 | B1 * | 12/2004 | Currey | 37/142.5 |
| 6,986,425 | B2 | 1/2006 | Paladin | |
| 7,000,779 | B2 | 2/2006 | Smook | |
| 7,204,046 | B2 * | 4/2007 | Currey | 37/142.5 |
| 2001/0004059 | A1 | 6/2001 | Davis | |
| 2003/0062294 | A1 | 4/2003 | Davis et al. | |
| 2003/0089645 | A1 | 5/2003 | Backers | |
| 2004/0069693 | A1 | 4/2004 | Paladin | |

FOREIGN PATENT DOCUMENTS

JP 2000319922 A * 11/2001

* cited by examiner

*Primary Examiner*—Patrick Mackey
*Assistant Examiner*—Terrell H Matthews
(74) *Attorney, Agent, or Firm*—Schmeiser, Olsen & Watts, LLP

(57) ABSTRACT

A mechanical bucket for separating small material from larger material. The mechanical bucket includes a bucket adapted to receive and retain material within the bucket and a roller screen assembly removably secured to a bottom portion of the bucket. The material received within the bucket rests on the roller screen assembly when deactivated. The roller screen assembly is adapted to separate smaller material from larger material of the material received within the bucket when activated. The mechanical bucket may include a scraper device for removing debris from the roller screen assembly when the roller screen assembly is activated.

19 Claims, 5 Drawing Sheets

MECHANICAL BUCKET

BACKGROUND OF THE INVENTION

1. Technical Field

This invention relates generally to a mechanical bucket and more particularly to a mechanical bucket that separates smaller material from larger material.

2. State of the Art

The separation of smaller material from larger material is common in instances such as excavation wherein the smaller material is desired at one location and the larger material is desired to be at a second location. This is commonly performed in a process that requires several steps to complete.

For example, a vehicle such as, but not limited to a hydraulic excavator or backhoe, may use a bucket or other device to collect a particular amount of material. The material may be deposited into a separating device, such as a screen or disc screen separator. The smaller material is separated from the larger material. The smaller material may then be transported to a first location and the larger material may be transported to a second location. There are several limitations to these common or conventional forms of separating smaller material from larger material.

One limitation includes having multiple pieces of equipment to perform the separation of the material. A vehicle is required to collect the material. A separating device then separates the smaller material from the larger material. A vehicle may be employed to deliver the smaller material to a first location and another vehicle may be employed to deliver the larger material to second location. This creates a time consuming process of separating material.

Another limitation is present when debris collects or becomes lodged in particular components of a separating device and hinders proper functionality of the separating device. For example, in a disc screen or roll screen separator, debris may hinder the rotation of the discs or rollers that perform the separating of the smaller material from the larger material. The removal of the debris requires additional equipment to dislodge and/or remove the debris to allow proper functionality of the separating device to properly perform separation of material.

Accordingly, there is a need for an improved separating device that requires less equipment and has the ability to remove debris from the separating device.

DISCLOSURE OF THE INVENTION

The present invention relates to a mechanical bucket that includes a separating device removably secured to a bottom portion of the bucket for separating smaller material from larger material. The separation is performed in the bucket and requires only one piece of equipment.

An aspect of the present invention includes a mechanical bucket for separating small material from larger material. The mechanical bucket includes a bucket adapted to receive and retain material within the bucket and a roller screen assembly removably secured to a bottom portion of the bucket. The material received within the bucket rests on the roller screen assembly when deactivated. Further, the roller screen assembly is adapted to separate smaller material from larger material of the material received within the bucket when activated.

Another aspect of the present invention includes a material separator comprising a mechanical bucket defining an inner volume. The mechanical bucket is adapted to couple to a vehicle, the mechanical bucket being movable between a first location and a second location by use of the vehicle. The material separator further comprises a roller screen assembly removably secured to a bottom portion of the mechanical bucket. Material received within the mechanical bucket rests on the roller screen assembly when deactivated. The roller screen assembly is adapted to separate smaller material from larger material of the material received within the mechanical bucket when activated. The smaller material passes through the roller screen assembly and is deposited in the first location and the larger material remains in the mechanical bucket. The material separator also includes sub-base removably coupled to the bottom portion of the mechanical bucket. The sub-base is adapted to removably secure the roller screen assembly to the bucket.

Another aspect of the present invention includes a method of using a mechanical bucket for separating smaller material from larger material, the method comprising receiving material within a mechanical bucket, the material including smaller material and larger material and moving the mechanical bucket to a location for depositing the smaller material. The method of the present invention further includes the steps of activating a roller screen assembly of the mechanical bucket to separate the smaller material from the larger material and depositing the smaller material in the location, wherein the smaller material during separation passes through the roller screen assembly and is deposited in the location.

The foregoing and other features and advantages of the present invention will be apparent from the following more detailed description of the particular embodiments of the invention, as illustrated in the accompanying drawings.

DETAILED DESCRIPTION OF EMBODIMENTS OF THE INVENTION

As discussed above, embodiments of the present invention relate to a mechanical bucket that includes a separating device removably secured to a bottom portion of the bucket for separating smaller material from larger material. The separation is performed in the bucket and requires only one piece of equipment. Generally the mechanical bucket includes a bucket and a roller screen assembly removably secured to a bottom portion of the bucket.

Figure 1:
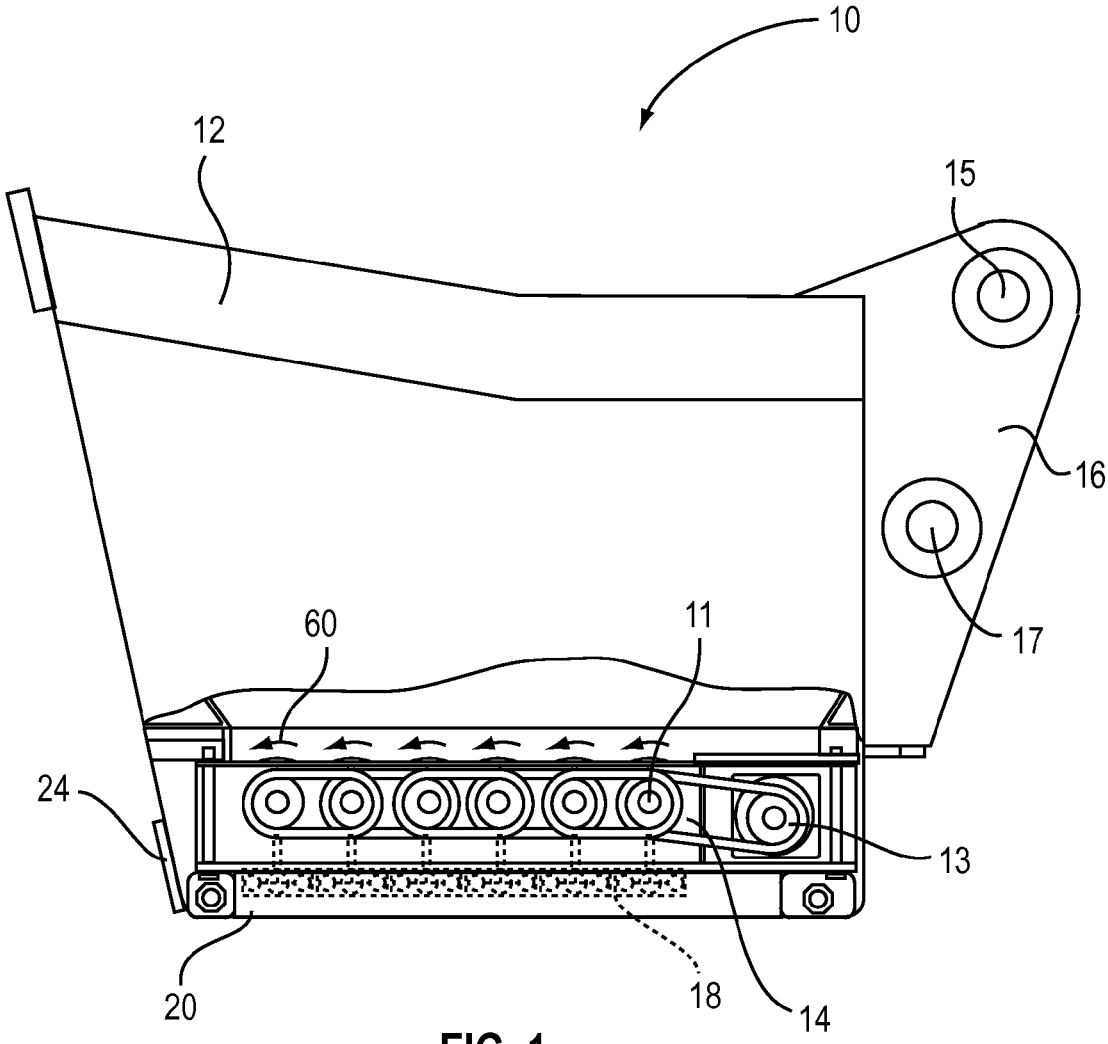
FIG. 1 is a side view with a cut away portion of a mechanical bucket in accordance with particular embodiments of the present invention.
Figure 2:
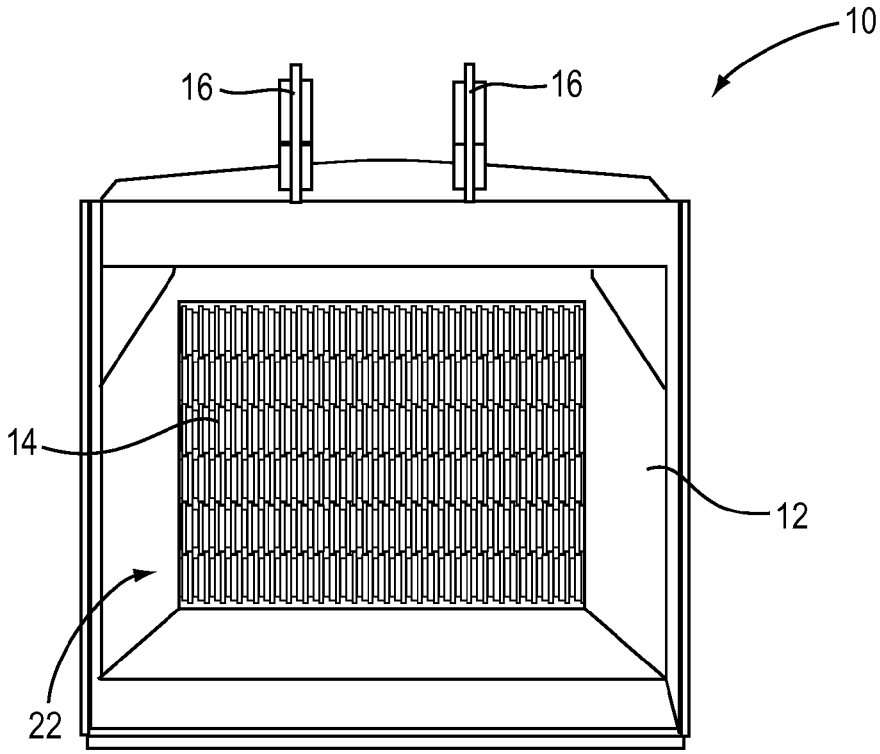
FIG. 2 is a top view of a mechanical bucket in accordance with the present invention.
Figure 3:
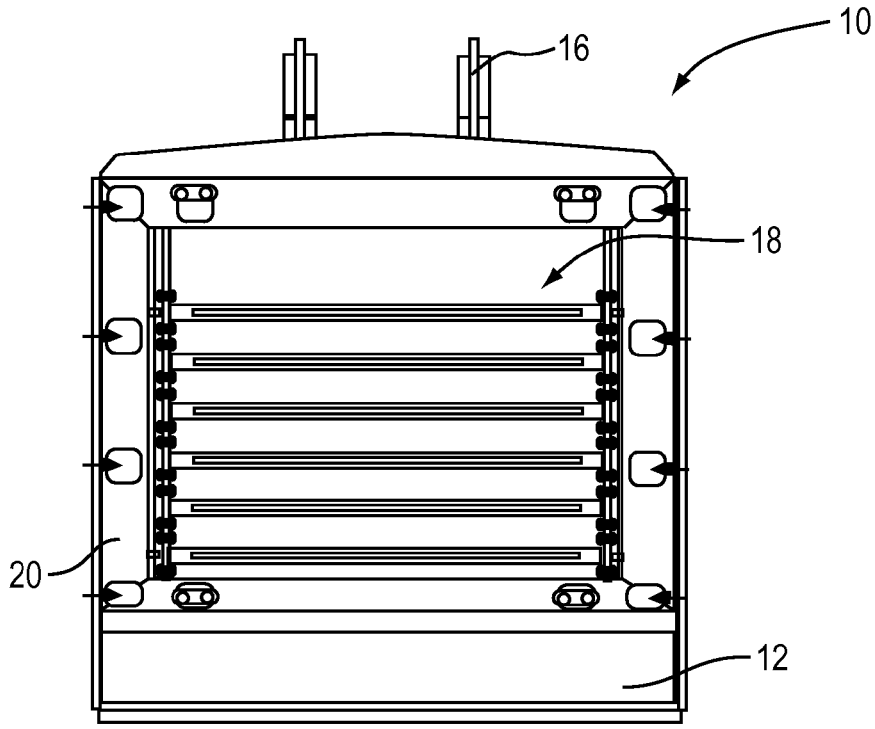
FIG. 3 is a bottom view of a mechanical bucket in accordance with the present invention.

Referring to the drawings, FIGS. 1-3, depict a mechanical bucket 10 in accordance with particular embodiments of the present invention. The mechanical bucket 10 includes a bucket 12, a roller screen assembly 14 and a sub-base 20. The roller screen assembly is removably secured to a bottom portion 24 of the bucket 12. In particular embodiments of the present invention, the sub-base 20 is coupled to the bottom portion 24 of the bucket 12, wherein the sub-base 20 removably secures the roller screen assembly 14 to the bottom portion 24 of the bucket 12. The bucket 12 further includes mounting ears 16. The mounting ears 16 comprise mounting apertures 15, 17 for mounting to a vehicle, such as, but not limited to, a hydraulic excavator and/or backhoe.

Particular embodiments of the mechanical bucket 10, in accordance with the present invention, may include a scraper device 18. The scraper device 18 is coupled adjacent the roller screen assembly 14. The sub-base 20 may couple the scraper device 18 adjacent the roller screen assembly 14. The scraper device 18 is used to remove debris from the roller screen assembly 14.

The bucket 12 includes an opening 22 for receiving material within the bucket 12. The material rests on the roller screen assembly 14 without any substantial portion of the material falling through the roller screen assembly 14 when the roller screen assembly is deactivated. Upon activation of the roller screen assembly 14, the roller screen assembly is adapted to allow smaller material to be separated from larger material. The activation of the roller screen assembly 14 agitates the material and allows smaller material to pass through the roller screen assembly 14 while the larger material remains within the bucket 12, resting on the roller screen assembly 14.

It will be understood that various types of roller screen assemblies may be used with the mechanical bucket 10. The rollers of the roller screen assembly may have discs of any shape and size. For example and without limitation, the shape of the discs may be round, triangular, circular, oval, square, rectangular, an ogive, a star and any other shape usable within a roller screen assembly 14. The roller screen assembly may further allow for various sized material to pass through the roller screen assembly 14, while still separating the larger material from the smaller material, thereby allowing various sizes of material to pass through while still restricting the material greater that the desired sized of material from passing through the roller screen assembly 14.

In particular embodiments of the present invention, the mechanical bucket 10 may activate the roller screen assembly 14 at variable revolutions per minute (RPM) or at a variable rotational speed. This allows the various types of roller screen assemblies to be used with the mechanical bucket 10 wherein the RPM may be adjusted for reasons including, but not limited to the types of discs being used on the rollers and the material to be separated. Additionally, the roller screen assembly 14 when activated gradually reaches operating speed and when deactivated gradually reaches stopping speed. For example, the roller screen assembly 14 may be driven to its operating speed at a predetermined rate when activated and may further be driven from operating speed to a stop at a predetermined rate when deactivated. This gradual increase and decrease in speed of the roller screen assembly provides for less wear on the roller screen assembly 14, thereby prolonging the life of the roller screen assembly 14 and reducing the frequency of repairs and replacements of the roller screen assembly 14.

Figure 4A:
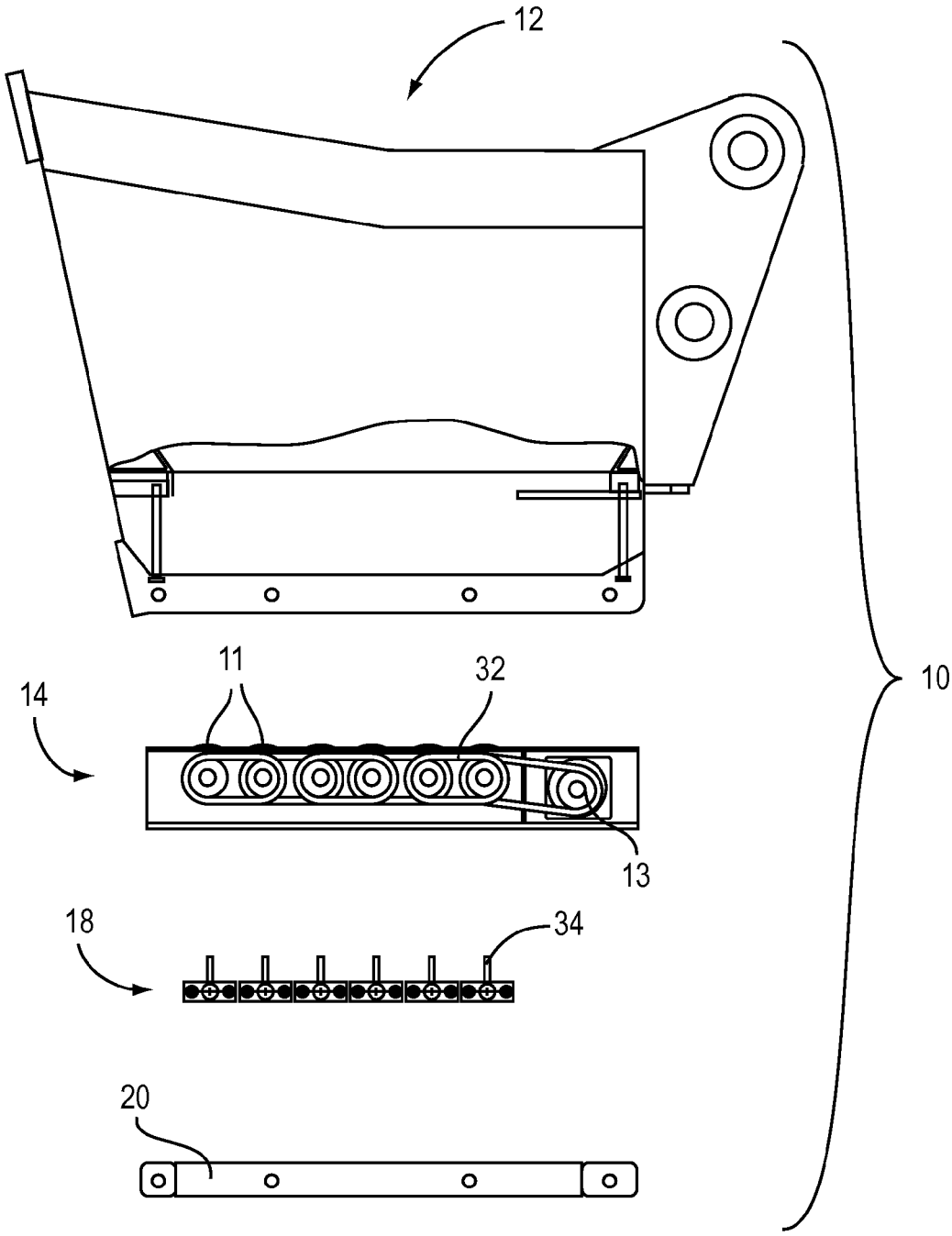
FIG. 4A is a side exploded view of a the mechanical bucket of FIG. 1 in accordance with particular embodiments of the present invention.
Figure 4B:
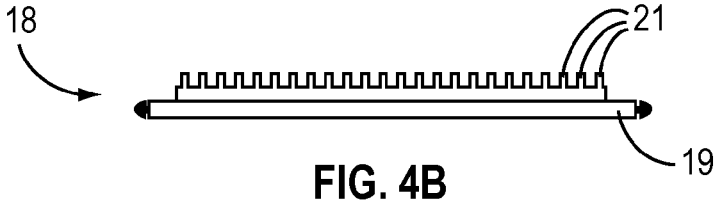
FIG. 4B is a front view of scraper device in accordance with particular embodiments of the present invention.

Referring again to the drawings, FIGS. 4A and 4B depict an exploded view of a mechanical bucket 10 and a front view of a scraper device 18 respectively. The mechanical bucket in accordance with particular embodiments of the present invention includes a bucket 12, a roller screen assembly 14, and a sub-base 20, and may include a scraper device 18. The roller assembly may include a plurality of rollers 11, a motor 13 and a plurality of chains 32 driving the roller screen assembly 14 when activated. The plurality of rollers 11 are adapted to rotate in a same direction 60 (See FIG. 1) when the roller screen assembly 14 is activated by the motor 13 and chains 32. The motor 13 may be adapted to gradually bring the roller screen assembly 14 to operating speed upon activation and to gradually bring the roller screen assembly 14 to a stop upon deactivation. Further, the motor 13 may operate the roller screen assembly 14 at variable revolutions per minute.

The scraper device may include a plurality of scrapers 34 coupled within the scraper device 18, wherein the number of scrapers 34 corresponds to the number of rollers 11. A scraper 34 includes a base portion 19 and a plurality of extensions 21. The extensions 21 extend in a direction transverse to the base portion 19. The plurality of extensions 21 engages the roller screen assembly 14 to scrape debris from the roller screen assembly 14. It will be understood by those of ordinary skill in the art that various types of scraper devices may be employed, so long as they remove debris from the roller screen assembly.

Figure 5A:
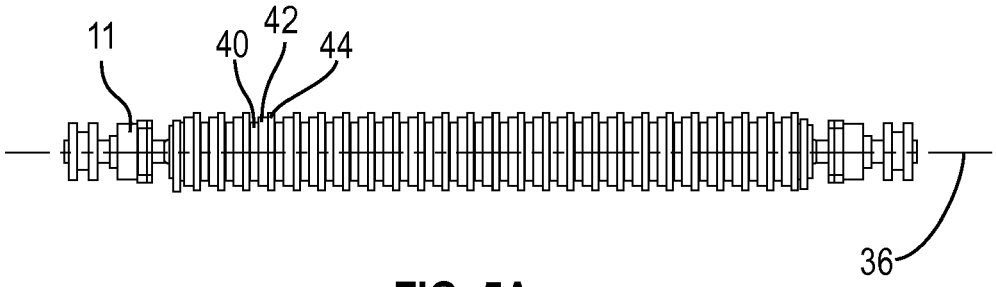
FIG. 5A is a side view of a roller of a roller screen assembly in accordance with the present invention.

Referring further to the drawings, FIG. 5A depicts a roller 11 of the roller assembly 14, in accordance with embodiments of the present invention. The roller 11 includes a plurality of portions 40, 42, 44, each portion having one of a first radius (portion 40), a second radius (portion 42) and a third radius (portion 44). The first radius is smaller than the second radius and the second radius is smaller than the third radius. Each portion 40, 42, 44 of the rollers are coupled together in a repeating pattern for a predetermined length. The pattern includes a portion having the first radius (portion 40) coupled to a portion having the second radius (portion 42), the portion having the second radius (portion 42) coupled to a portion having the third radius (portion 44), and the portion having the third radius (portion 44) coupled to another portion having the first radius (portion 40). It will be understood that while a particular pattern is shown in FIG. 5A, other patterns may be implemented while providing the same or substantially the same benefit and functionality.

Figure 5B:
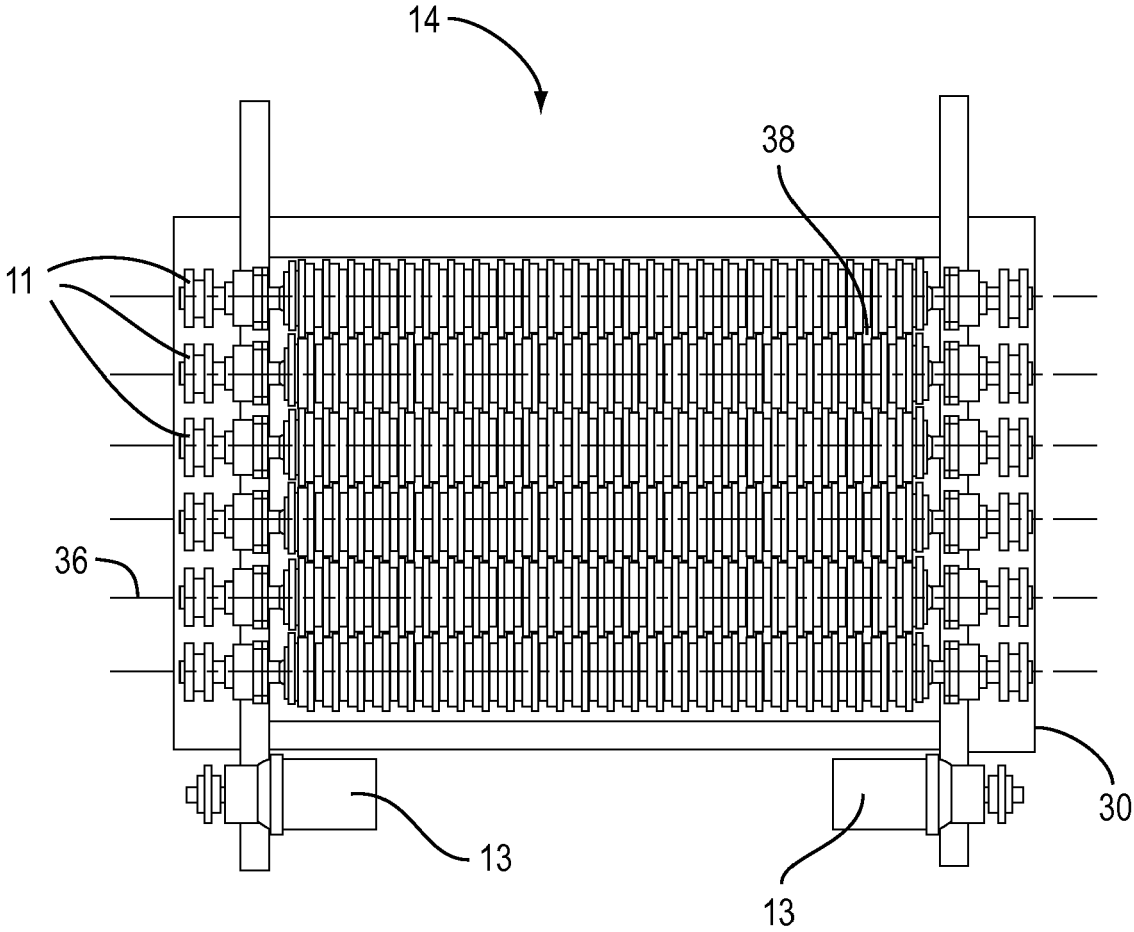
FIG. 5B is a top view of a roller screen assembly in accordance with the present invention.

With additional reference to FIG. 5B, each roller 11 has an axis 36. A plurality of rollers 11 are coupled together within the roller screen assembly 14. The axes 36 of the plurality of rollers 11 in the roller screen assembly 14 are substantially parallel within substantially a same plane. Further, the plurality of rollers 11 of the roller screen assembly 14 are coupled adjacent each other and are oriented in opposite directions such that portions having the first radius (portion 40) are adjacent each other defining a gap 38 of a predetermined size and portions having the second radius (portion 42) are adjacent portions having the third radius (portion 44). This allows for only material having a size smaller than the gap 38 between the portions having the first radius (portion 40) to pass through the roller screen assembly 14, thereby separating the smaller material from the larger material. The separation is performed by activating a motor 13 and thereby turning the rollers 11 in the same direction 60 (See FIG. 1), such that material is agitated allowing the smaller material to pass through the roller screen assembly 14 while retaining the larger material on the roller screen assembly 14. Once the material is separated, the motor 13 is deactivated thereby deactivating the roller screen assembly 14. Particular embodiments of the present invention include chain guards 30 to protect the chains 32 (FIG. 4A) of the roller screen assembly 14.

Figure 6:
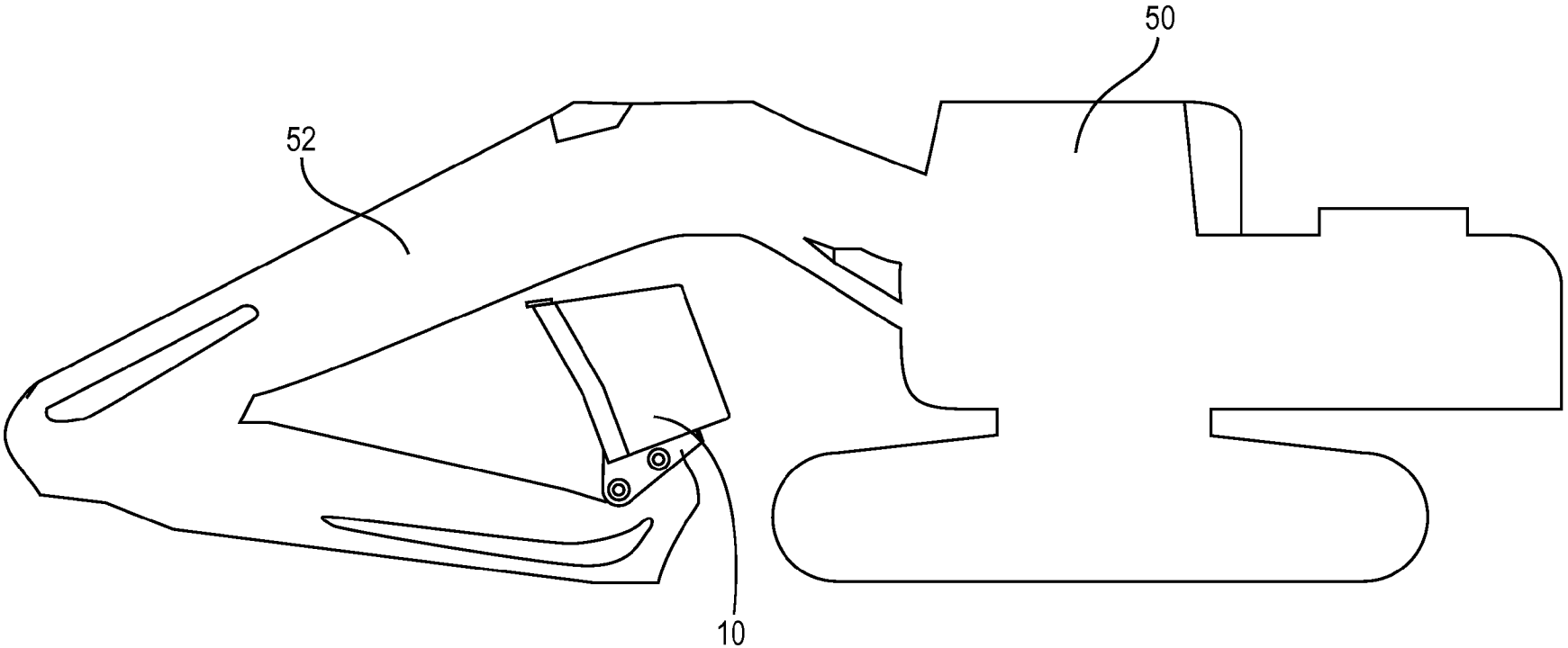
FIG. 6 is a side view of a vehicle with a mechanical bucket in accordance with the present invention.

As shown in FIG. 6, particular embodiments may include a material separator comprising a mechanical bucket 10 that is adapted to couple to a vehicle 50 in accordance with the present invention. The mechanical bucket 10 may be coupled to an arm 52 of the vehicle 50. The vehicle 50 may be any type of vehicle, including but not limited to, a hydraulic excavator and a backhoe. The vehicle 50 may utilize the mechanical bucket 10 in a typical manner to scoop or otherwise receive material within the mechanical bucket 10. The mechanical bucket 10 may then be moved to a first location where it is desired that material of smaller size is to be deposited. The mechanical bucket 10 is then activated to separate the smaller material from the larger material, the smaller material passing through the roller screen of the mechanical bucket 10 and is deposited in the first location. Once the separating is completed, the vehicle 50 moves the mechanical bucket 10 to a second location for depositing the larger material by dumping it out of the mechanical bucket 10 in a typical dumping fashion by rotating the mechanical bucket 10. The present invention allows for the separation of material with a single piece of equipment, increasing efficiency.

It will be understood that various sizes of mechanical buckets may be employed dependent on various factors such as, but not limited to, the amount of material to be separated and/or the size of the vehicle. Further, the roller screen assembly may also be of various sizes and include various amounts of the plurality of rollers, wherein the roller assembly is comparable to the size of the mechanical bucket.

Other particular embodiments of the present invention include a method of using a mechanical bucket for separating smaller material from larger material. The method comprises the steps of receiving material within a mechanical bucket, the material including smaller material and larger material and moving the mechanical bucket to a location for depositing the smaller material. The method further includes the steps of activating a roller screen assembly of the mechanical bucket to separate the smaller material from the larger material and depositing the smaller material in the location, wherein the smaller material during separation passes through the roller screen assembly and is deposited in the location.

In particular embodiments, the method further comprises the steps of agitating the material to facilitate separation of the smaller material from the larger material and retaining the larger material within the mechanical bucket. The method also includes the step of deactivating the roller screen assembly when separation of the smaller material from the larger material is completed. Additionally, the method may also include the steps of moving the mechanical bucket to a second location and dumping the larger material in the second location.

It will be understood that other various steps may include, attaching the mechanical bucket to a vehicle, removing the roller screen assembly from the mechanical bucket, securing the roller screen assembly to the bucket using a sub-base, scraping debris from the roller screen assembly by use of a scraper device.

The embodiments and examples set forth herein were presented in order to best explain the present invention and its practical application and to thereby enable those of ordinary skill in the art to make and use the invention. However, those of ordinary skill in the art will recognize that the foregoing description and examples have been presented for the purposes of illustration and example only. The description as set forth is not intended to be exhaustive or to limit the invention to the precise form disclosed. Many modifications and variations are possible in light of the teachings above without departing from the spirit and scope of the forthcoming claims.

The invention claimed is:

1. A mechanical bucket for separating small material from larger material, the mechanical bucket comprising:

a bucket adapted to receive and retain material within the bucket;

a roller screen assembly removably secured to a bottom portion of the bucket, wherein material received within the bucket rests on the roller screen assembly when deactivated, the roller screen assembly adapted to separate smaller material from larger material of the material received within the bucket when activated, the smaller material passing through the screen and the larger material remaining in the bucket; and a scraper device coupled to the bucket adjacent to a bottom side of the roller screen assembly, wherein the scraper removes debris from the roller screen assembly.

2. The mechanical bucket of claim 1, wherein the scraper device includes a base portion and a plurality of extensions that extend in a direction transverse to the base portion, the extensions engaging the roller screen to scrape debris from the roller screen.

3. The mechanical bucket of claim 1, wherein the roller screen assembly is adapted to agitate the material within the bucket when the roller screen assembly is activated.

4. The mechanical bucket of claim 3, wherein the roller screen assembly is driven to its operating speed at a predetermined rate when activated.

5. The mechanical bucket of claim 4, wherein the roller screen assembly is driven to a stop from operating speed at a predetermined rate when deactivated.

6. The mechanical bucket of claim 5, wherein the roller assembly when activated operates at a variable rotational speed.

7. The mechanical bucket of claim 1, further comprising a sub-base, the sub-base removably coupled to the bottom portion of the bucket, the sub-base adapted to removably secure the roller screen assembly to the bucket.

8. A material separator comprising:

a mechanical bucket defining an inner volume, the mechanical bucket adapted to couple to a vehicle, the mechanical bucket movable between a first location and a second location by use of the vehicle;

a roller screen assembly removably secured to a bottom portion of the mechanical bucket, wherein material received within the bucket rests on the roller screen assembly when deactivated, the roller screen assembly adapted to separate smaller material from larger material of the material received within the bucket when activated, the smaller material being passed through the roller screen assembly and deposited at the first location and the larger material remaining in the bucket;

a scraper device coupled to the bucket adjacent to a bottom side of the roller screen assembly, wherein the scraper removes debris from the roller screen assembly; and a sub-base removably coupled to the bottom portion of the mechanical bucket, the sub-base adapted to removably secure the roller screen assembly to the bucket.

9. The mechanical separator of claim 8, wherein the roller screen assembly is adapted to agitate the material within the bucket when the roller screen assembly is activated.

10. The material separator of claim 8, further comprising a motor mechanically engaged with the roller screen assembly.

11. The material separator of claim 10, wherein motor is driven to its operating speed at a predetermined rate upon activation.

12. The material separator of claim 11, wherein the motor is driven to a stop from its operating speed at a predetermined rate upon deactivation.

13. The material separator of claim 12, wherein the motor operates the roller screen assembly at a variable rotational speed.

14. The material separator of claim 8, wherein the mechanical bucket is adapted to rotate for dumping the larger material at the second location.

15. A method of using a mechanical bucket for separating smaller material from larger material, the method comprising:

receiving material within a mechanical bucket, the material including smaller material and larger material;

moving the mechanical bucket to a location for depositing the smaller material;

activating a roller screen assembly of the mechanical bucket to separate the smaller material from the larger material;

removing debris from the roller screen assembly with a scraper; and depositing the smaller material at the location, wherein the smaller material during separation passes through the roller screen assembly and is deposited at the location.

16. The method of claim 14, further comprising agitating the material to facilitate separation of the smaller material from the larger material.

17. The method of claim 14, further comprising retaining the larger material within the mechanical bucket.

18. The method of claim 14, further comprising deactivating the roller screen assembly when separation of the smaller material from the larger material is completed.

19. The method of claim 14, further comprising:

moving the mechanical bucket to a second location; and dumping the larger material in the second location by rotating the bucket.

* * * * *